US009237403B2

(12) United States Patent
Fichtl

(10) Patent No.: US 9,237,403 B2
(45) Date of Patent: Jan. 12, 2016

(54) METHOD OF ADJUSTING A BINAURAL HEARING SYSTEM, BINAURAL HEARING SYSTEM, HEARING DEVICE AND REMOTE CONTROL

(75) Inventor: Elmar Fichtl, Uerikon (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/356,970

(22) PCT Filed: Nov. 11, 2011

(86) PCT No.: PCT/EP2011/069973

§ 371 (c)(1),
(2), (4) Date: May 8, 2014

(87) PCT Pub. No.: WO2013/068051

PCT Pub. Date: May 16, 2013

(65) Prior Publication Data

US 2014/0307903 A1 Oct. 16, 2014

(51) Int. Cl.
*H04R 25/00* (2006.01)

(52) U.S. Cl.
CPC ..... *H04R 25/50* (2013.01); *H04R 25/552* (2013.01); *H04R 25/558* (2013.01); *H04R 25/70* (2013.01); *H04R 25/554* (2013.01); *H04R 2225/39* (2013.01); *H04R 2225/41* (2013.01)

(58) Field of Classification Search
CPC .... H04R 25/552; H04R 25/558; H04R 25/50; H04R 25/70; H04R 2225/39; H04R 2225/41
See application file for complete search history.

(56) References Cited

U.S. PATENT DOCUMENTS

2004/0013280 A1* 1/2004 Niederdrank ..... 381/315
2007/0223753 A1 9/2007 Latzel (Continued)

FOREIGN PATENT DOCUMENTS

WO 2008/006772 A2 1/2008
WO 2010/145698 A1 12/2010

OTHER PUBLICATIONS

International Search Report Issued in Application No. PCT/EP2011/069973 dated Oct. 19, 2012.

(Continued)

*Primary Examiner* — Tuan D Nguyen
(74) *Attorney, Agent, or Firm* — Pearne & Gordon LLP

(57) ABSTRACT

The present invention is related to the adjusting of a binaural hearing system and devices being operable according to said method. The hearing system comprises two hearing devices (10, 20), each comprising a signal processing unit (12, 22) for processing an audio input signal according to at least one hearing program (P) to provide an output signal being forwarded to an output transducer (13, 23) of the respective hearing device (10, 20). The method comprises the steps of:

determining device information ($ACCorr(P)_{ipsi}$, $ACCorr(P)_{contra}$) being related to the hearing devices (10, 20) and to at least one hearing device specific adjustment having been applied earlier to the at least one hearing program (P);

calculating synchronization data (learnt_pref(P)) according to a function that depends on the device information ($ACCorr(P)_{ipsi}$, $ACCorr(P)_{contra}$); and;

synchronizing the hearing devices (10, 20) by taking into account the synchronization data (learnt_pref(P)).

24 Claims, 2 Drawing Sheets

(56) References Cited

U.S. PATENT DOCUMENTS

| | | | | |
|---|---|---|---|---|
| 2007/0269065 | A1* | 11/2007 | Kilsgaard | 381/315 |
| 2010/0111338 | A1 | 5/2010 | Ypma | |
| 2011/0129094 | A1* | 6/2011 | Petersen | 381/23.1 |

OTHER PUBLICATIONS

Written Opinion issued in Application No. PCT/EP2011/069973 dated Oct. 19, 2012.

* cited by examiner

METHOD OF ADJUSTING A BINAURAL HEARING SYSTEM, BINAURAL HEARING SYSTEM, HEARING DEVICE AND REMOTE CONTROL

TECHNICAL FIELD OF THE INVENTION

The present invention is related to a method for adjusting a binaural hearing system and devices being operable according to said method such as a binaural hearing system, a hearing device and a remote control.

BACKGROUND OF THE INVENTION

A hearing impairment often affects both ears of a person, so that the hearing impaired person is supplied with two hearing devices, one for each ear. If the operation of one hearing device is coordinated to the operation of other hearing device, the hearing devices are regarded as components of a so called "binaural" hearing system.

A binaural hearing system is known from WO 2008/006772 A2, which further discloses a method for adjusting the level of coordination between the two hearing devices. Thereby the level of coordination is determined according to a momentary acoustic situation in order to adjust the hearing system to an asymmetric hearing situation, for example a situation encountered during a telephone call.

SUMMARY OF THE INVENTION

The present invention has the objective to propose an improved method for adjusting a binaural hearing system and improved devices such as a binaural hearing system, a hearing device and a remote control.

This objective is reached by a method comprising the features specified in claim 1. Devices according to the invention, namely a binaural hearing system, a hearing device and a remote control as well as further embodiments of invention are specified in the dependent claims.

Under the term "hearing device" a device is understood, which is worn in or adjacent to the user's ear with the objective to improve the user's acoustical perception. In particular, a hearing device refers to:

- a hearing aid for improving the perception of a hearing impaired user towards the hearing perception of a user with normal hearing ability,
- a hearing protection for attenuating or baring acoustic signals from being perceived by the user, or
- a communication device, in particular to be used by a user with normal hearing ability, for assisting the hearing perception under difficult acoustical circumstances, for example in a noisy environment.

With respect to any application area, a hearing device may be applied behind the ear, in the ear, completely in the ear canal or may be implanted.

A "hearing program", also called signal processing parameters or hearing device settings, controls the signal processing of the hearing system in dependence to a specific acoustic situation such as a noisy environment or a situation related to a telephone call. In the present invention, the hearing program represents a specific acoustic situation for at least one of the two hearing devices. The appropriate hearing program is determined by a so called "classifier". In the present invention the classifier operates independently for each hearing device or for both hearing devices in common. In one example, the classifier comprises two parts, each part being assigned to one of the two hearing devices. In a further example, the classifier is located at one of the hearing devices or at a further device such as a remote control.

The "binaural" hearing system comprises two hearing devices, wherein the operational behavior of one of the two hearing devices is coordinated to the operational behavior of the other of the two hearing devices. The term "synchronization" or "binaural synchronization" as used throughout this description and the claims refers to such a coordination, which may or may not include a so called "time synchronization" being used to establish a physical time relation between two devices.

The invention involves a method for adjusting a binaural hearing system, the hearing system comprising two hearing devices, each comprising a signal processing unit for processing an input signal according to at least one hearing program to provide an output signal being forwarded to an output transducer of the respective hearing device. The method comprises the steps of:

- determining device information being related to the hearing devices and to at least one hearing device specific adjustment having been applied earlier to the at least one hearing program;
- calculating synchronization data according to a function that depends on the device information; and
- synchronizing the hearing devices by taking into account the synchronization data.

Such an adjustment provides for an efficient, robust and cost effective method, because it does not require an additional sensory system or rules for identification of certain situations.

In the present invention, the adjusting of the binaural hearing system is performed during the operation of the hearing system and is either initiated by the user or initiated automatically without user interaction. As an example, this synchronization is applied on the long run and/or frequently, for example according to predetermined time intervals, e.g. every hour or as soon as changes of the hearing program have to be applied, for example during the applying of so called "User Preference Learning".

Throughout the description and the claims, the term "determining" also includes a process of receiving. Consequently, the step of determining device information may include, at least partly, the receiving of device information or data relating to the at least one hearing device specific adjustment via a data connection, e.g. wire-bound or wireless connection.

In one example, the device information or the hearing device specific information, for example average control corrections per program and/or usage times per program, is transferred via an electro-magnetic wireless connection. Also an infra-red connection (IR) may be used. In another example, the device information is determined from local user input, e.g. from control corrections on a remote control.

In a further example, the device information or the hearing device specific information is transferred via a direct connection from one hearing device to the other hearing device or via an additional intermediate device, for example via a further device such as a remote control. In a further example, the step of synchronization is mutual by using a bidirectional transfer of the synchronization data; in another example, the synchronization is unilateral, using a unidirectional transfer of the synchronization data.

Surprisingly, the invention is particular advantageous in case of asymmetrically operated hearing devices, namely in the case of each of the hearing devices being operated according to different hearing programs or to different device specific parts of the hearing program. The reasons for such an asymmetry may for example relate to:

a) differing sound class determination, e.g. due to an asymmetric sound situation, for example by using two independent classifiers (left and right), which supports the main task of the classifier to provide optimal hearing support in every situation, i.e. also in asymmetric hearing situations (In such situations asymmetric classification is very reasonable and a complete or partly synchronizing of the signal processing may only be useful in a limited range of applications),
b) asymmetric usage of hearing instruments, which can be intended or unintended, e.g. if the user wishes to save batteries or suffers from poor battery on one side,
c) imperfect application of control inputs, e.g. due to insufficient synchronization, in particular insufficient link between a remote control and the hearing devices, heavily asymmetric sound situations, asymmetric degradation of e.g. hearing device microphones, or
d) asymmetric preferences of the customer, e.g. due to asymmetric hearing loss.

Further, the hearing system may become asymmetric by functions which, on the long run, change settings of the hearing devises such as preference learning or acclimatization management.

In one example, the above mentioned partly synchronizing of the signal processing or the complete suppression of this synchronization relates to the beam-forming in asymmetric hearing situations. In particular, in such a situation the beamforming of each hearing device or variants thereof may be operated independently for each ear, i.e. non-binaurally.

With the method according to the invention, the user can effectively and/or conveniently return to symmetric operation, i.e. bring the asymmetrically operated hearing system into synchronization again, in all of the above mentioned cases.

This invention can be applied to any hearing system that is adapted for synchronization. In one example, at least one of steps of the method, in particular the determining of device information, the calculating of synchronization data or the synchronizing of the hearing devices, is at least partly performed by at least one of the following: the first hearing device, the second hearing device or a further device such as a remote control.

The advantages of the method according to the invention are:

The hearing devices operate in an appropriate way, for example in asymmetric situations each hearing device provides optimal hearing support.

The hearing device settings do not diverge in the course of time.

The hearing performance is not degraded by asymmetric learning.

A Fitter can get full information about asymmetric logged data, but "User Preference Learning" does not result in asymmetrically tuned hearing devices.

The user is safeguarded against inappropriate asymmetric hearing device settings.

Inconspicuousness for the user.

A definition of a master/slave hearing device is not necessary.

The connection between the constituents of the hearing system, in particular the connection between the two hearing devices, is only used during the application of the method according to the invention (e.g. every hour). Therefore neither a permanent connection, nor a frequently, e.g. every minute, used connection nor a stable connection is needed. This allows, for example, using a rather unstable connection and/or a power supply with small capacity batteries.

In one example, the device information or the hearing device specific information, in particular the control corrections per program, is determined from statistical data, in particular from a time series that is mapped to a single value or from a plurality of time series each being mapped to a single value. This has the advantage that the space requirement for storing data is very low, because no data history needs to be stored. In one example, the mapping is accomplished by time-weighted averaging. In another example, the resulting single values are stored in a memory unit for later use.

In a further embodiment of the method according to the invention, the step of determining device information comprises evaluating logged data, in particular logged control corrections. This way, a reproducible data base with correctly recorded data of the behavior of the hearing devices is available. From this logged data a fitter can get helpful information at a next fitting session.

In one example, each hearing device is configured to log data independently. Consequently, data logging of one hearing device is continued in case the other hearing device is not accessible or not available. In this case the one hearing device only applies its own logged data.

In another example, the logged data comprises event data being related to the occurrence of an event (e.g. user input of control data) and time data being indicative of the time of this occurrence.

In a further embodiment of the method according to the invention, the function additionally depends on hearing device specific time information and/or on hearing program specific time information, in particular a usage time or an acclimatization time. This time information can easily be determined without requiring user interactions or an additional sensory system or rules for identification of certain situations.

In a further embodiment of the method according to the invention, the function is a weighted average of the device information with weighting factors that correspond to the time information. This allows for an efficient evaluation of the available information.

In a further embodiment of the method according to the invention, at least one of the following: the hearing program, the device information or the synchronization data comprises two parts, the first part being related to the first hearing device and the second part being related to the second hearing device.

In a further embodiment of the method according to the invention, the synchronization data comprises learnt preference data, wherein the device information is at least one control correction, in particular an average over multiple control corrections, and the time information is a usage time. The learnt preference data relates to usage patterns and/or user preferences, which are determined in an earlier situation and automatically applied later in a similar situation. The learnt preference data may be determined from earlier logged data, i.e. a history, and/or from statistical data, in particular from data obtained by time-weighted averaging. Thus, the adjusting of the binaural hearing system is based on a preference learning algorithm, also called "User Preference Learning".

In one example, said function calculates the previously mentioned learnt preference data learnt_pref(P) according to the expression:

$$\text{learnt_pref}(P) = \frac{(ACCorr(P)_{ipsi} * UT(P)_{ipsi}) + (ACCorr(P)_{contra} * UT(P)_{contra})}{(UT(P)_{ipsi} + UT(P)_{contra})}$$

with P being the hearing program, $ACCorr(P)_{ipsi}$ being an average control correction per hearing program P of the first or ipsi hearing device, $ACCorr(P)_{contra}$ being an average control correction per hearing program P of the second or contra hearing device, $UT(P)_{ipsi}$ being a usage time per hearing program P of the first hearing device and $UT(P)_{contra}$ being a usage time per hearing program P of the second hearing device. The result is applied by "User Preference Learning" functionality.

The term "ipsi" or "ipsi-lateral" refers to the hearing device being looked at, whereas the other hearing device is called a "contra" or "contra-lateral" hearing device. Thus, depending on the point of view, either the left or the right hearing device as well as the first or the second hearing device can be the ipsi hearing device, the other then being the contra hearing device.

In a further embodiment of the method according to the invention, the synchronization data comprises an acclimatization delta, wherein the device information is a hearing device specific acclimatization delta and the time information is an acclimatization time. The acclimatization delta defines time-dependent automatic adjustment of the hearing program to bring the hearing program from an initial state towards a target state, also called hearing program target. Thus, the result is determined by "Acclimatization Management" functionality.

In one example the acclimatization is independent from the hearing program or only a single hearing program is used. In this case the acclimatization delta is a global acclimatization delta and/or the acclimatization time is a global acclimatization time.

In one example, which may be a preferred example of a number of further examples, said function calculates the acclimatization delta ACCdelta(P) according to the expression:

$$ACCdelta(P) = \frac{(ACCdelta(P)_{ipsi} * AccT(P)_{ipsi}) + (ACCdelta(P)_{contra} * AccT(P)_{contra})}{(AccT(P)_{ipsi} + AccT(P)_{contra})}$$

with P being the hearing program, $ACCdelta(P)_{ipsi}$ being an acclimatization delta per hearing program P of the first or ipsi hearing device as the first difference data, $ACCdelta(P)_{ipsi}$ being an acclimatization delta per hearing program P of the second or contra hearing device, $AccT(P)_{ipsi}$ is an acclimatization time per hearing program P of the first hearing device and $AccT(P)_{contra}$ is an acclimatization time per hearing program P of the second hearing device.

In a further embodiment of the method according to the invention, said function additionally depends on side specific user hearing loss information. With this hearing loss information, a high flexibility for adapting the hearing device is achieved.

In one example, which may be a preferred example of a number of further examples, said function calculates the previously mentioned learnt preference data learnt_pref(P) according to the expression:

$$\text{leant_pref}(P) = \frac{(ACC(P)_{ipsi} * UT(P)_{ipsi} * f(HL)_{ipsi}) + (ACC(P)_{contra} * UT(P)_{contra} * f(HL)_{contra})}{(UT(P)_{ipsi} * f(HL)_{ipsi} + UT(P)_{contra} * f(HL)_{contra})}$$

with P being the hearing program, $ACCorr(P)_{ipsi}$ being an average control correction per hearing program P of the first or ipsi hearing device, $ACCorr(P)_{contra}$ being an average control correction per hearing program P of the second or contra hearing device, $UT(P)_{ipsi}$ being a usage time per hearing program P of the first or ipsi hearing device, $UT(P)_{ipsi}$ being a usage time per hearing program P of the second or contra hearing device, $f(HL)_{ipsi}$ being a ipsi-lateral hearing loss information of the user, i.e. on the first or right side, and $f(HL)_{contra}$ being a contra-lateral hearing loss information of the user, i.e. on the second or left side.

In case of an asymmetric hearing loss the user often uses the hearing devices in an asymmetric way, which may therefore result in asymmetric adaptation of the hearing program by "Preference Learning". Accordingly, weighted adjustments of the hearing program by the degree of hearing loss will benefit the ear, where a hearing device is used more often, normally the better ear, also called the "leading ear". However, with the method according to the invention the leading ear does not completely overrule the settings of the other hearing device.

Often the hearing device of the worse ear is used less than the other hearing device. The hearing device specific data, e.g. the usage time and the control correction, is additionally weighted by a weighting factor that is derived from the degree of the hearing loss of the respective ear; the milder the hearing loss of a particular ear is, the more impact makes the data from that ear. This follows the idea of the "leading ear". For this ear it is more beneficial to optimize the hearing program than for the worse one.

The values of the individual hearing loss information may be determined by the user or by a fitter. If needed, the synchronization of hearing devices can also be deactivated manually by the fitter, e.g. for certain asymmetric hearing losses.

In a further embodiment of the method according to the invention, the hearing system comprises a user control unit for each of the hearing devices and the method further comprises at least one of the following steps:

- deactivating the step of synchronization if the user control inputs between the hearing devices are repeatedly different;
- activating the step of synchronization if the user control inputs between the hearing devices are substantially identical.

This way the synchronization of hearing devices can conveniently be activated or deactivated, for example by manual user actions or voice commands.

In one example, the user control unit is implemented by a manual user interface such as a pair of switches, dialers or fields of a touch screen. In another example, the user control unit is comprised in one of the two hearing devices, commonly in both hearing devices or in a further device such as a remote control.

In a further embodiment of the method according to the invention, the hearing system calculates a prediction of the synchronization data, in particular repeatedly, e.g. every hour. The predicted synchronization data, the so called adjustment prediction, is applied to the signal processing of the hearing device, for example at a reboot of the hearing device or at a change of the hearing program.

Further, the invention involves a binaural hearing system comprising two hearing devices, each comprising a signal processing unit for processing an input signal according to at least one hearing program to provide an output signal being forwarded to an output transducer of the respective hearing device, an information unit for determining device information being related to hearing devices, a calculation unit for calculating synchronization data according to a function that depends on the device information, and a control unit for synchronizing the hearing devices by taking into account the synchronization data, wherein the information unit comprises a means for relating the device information to at least one hearing device specific adjustment having been applied earlier to the at least one hearing program.

In one example, at least one of the units, in particular the information unit, the calculation unit or the control unit, is at least partly comprised in at least one of the following: the first hearing device, the second hearing device or a further device such as a remote control. Thus, the each of the steps of determining device information, calculating synchronization data can be performed in the first hearing device, the second hearing device or both hearing devices and/or in the further device.

In a further embodiment, the hearing system according to the invention comprises a memory unit for storing device information or data related to the hearing device specific adjustment, in particular for logging data.

In a further embodiment, the hearing system according to the invention comprises a time measurement unit, in particular a counter or a clock, for determining time information relating to the hearing program, in particular to a usage time or to an acclimatization time.

In a further embodiment of the hearing system according to the invention, the calculation unit is configured to calculate a weighted average of the device information by using weighting factors that correspond to time information, in particular the time information determined according to the previous embodiment.

In a further embodiment of the hearing system according to the invention, the information unit is operationally connected to a receiving unit for receiving at least part of the device information or data being related to the at least one hearing device specific adjustment.

In an example, at least one of the units, in particular the signal processing unit, the information unit, the calculation unit or the control unit, is at least partly implemented by a digital component such as a DSP (Digital Signal Processor) or a digital filter. However, analog components may also be used. In a further example, at least one of the units is a programmable unit, for example a microprocessor or a FPGA. At least one of the units may also, at least partly, be implemented by fixed wired circuits, for example discrete electronic components or ASICs (application specific integrated circuit).

Further, the hearing system or the hearing device comprises several constituents, which are operationally connectable and which may be located at different places. Typically, said constituents are meant to be worn or carried by the user. For example, the constituents of the hearing system can be constituents for the left or the right ear of the user, a remote control, a remote input transducer or a remote output transducer.

Further, the invention involves a hearing device comprising:

a signal processing unit for processing an input signal according to at least one hearing program to provide an output signal being forwarded to an output transducer of the hearing device, an information unit for determining device information being related to the hearing device and a further hearing device, a calculation unit for calculating synchronization data according to a function that depends on the device information, and a control unit for adjusting the hearing device by taking into account the synchronization data, wherein the information unit comprises a means for relating the device information to at least one hearing device specific adjustment having been applied earlier to the at least one hearing program. This allows combining the hearing device according to the invention with a known synchronization enabled hearing device to obtain a synchronized hearing system according to the invention. This allows for a cost-efficient solution, in particular for upgrading.

In a further embodiment of the hearing device according to the invention, the information unit is operationally connected to a receiving unit for receiving from a further hearing device at least part of the device information or data being related to at least one hearing device specific adjustment.

As an example, the hearing device comprises a housing, an input transducer such as at least one microphone, a processing unit, an output transducer such as a loudspeaker. The input and output transducers convert an acoustical input signal to an, in particular analog or digital, electrical signal or vice versa and can be implemented by a great variety of devices. The transducer is a sound transducer such as microphone or loudspeaker, which may be based on electromagnetic, electrodynamic, electrostatic, piezoelectric or piezoresistive technology. The input transducer may also be implemented as a remote device such as a remote microphone, a stationary or mobile telephone, which receive and convert an acoustical input signal remotely and transmit the converted signal to the processing unit of the hearing device via a wire or wireless connection. Further, the output transducer may also convert the intermediate signal into a mechanical signal such as mechanical vibrations. The mechanical signal may then be applied directly to the hearing bone of the user. It may also be possible to convert the electrical signal into a further electrical signal that is applied directly to the acoustic organ of the user, e.g. by using a cochlear implant.

Further, the invention involves a remote control comprising:

an information unit for determining hearing device specific information, being related to two hearing devices, a calculation unit for calculating synchronization data according to a function that depends on the device information, and a control unit for synchronizing the hearing devices by taking into account the synchronization data, wherein the information unit comprises a means for relating the device information to at least one hearing device specific adjustment, having been applied earlier to the at least one hearing program.

In a further embodiment of the remote control according to the invention, the information unit is operationally connected to a receiving unit for receiving from at least one hearing device, in particular from both hearing devices, at least part of the device information or data being related to at least one hearing device specific adjustment.

It is expressly pointed out that any combination of the above-mentioned embodiments, or combinations of combinations, is subject to a further combination. Only those combinations are excluded that would result in a contradiction.

BRIEF DESCRIPTION OF THE DRAWINGS

Below, the present invention is described in more detail by means of exemplary embodiments and the included drawings. It is shown in.

BRIEF DESCRIPTION OF THE INVENTION

The described embodiments are meant as illustrating examples and shall not confine the invention.

Figure 1:
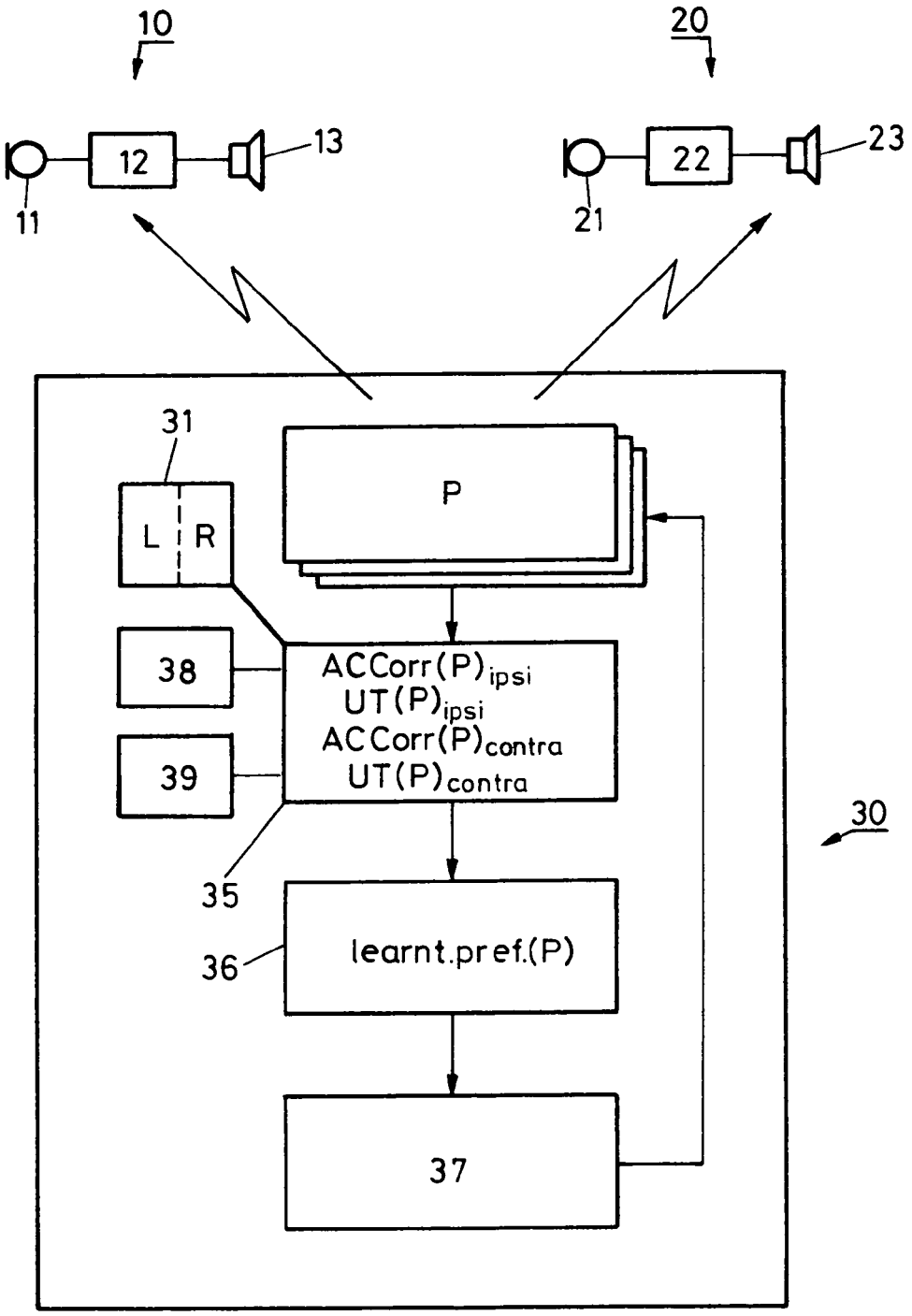
FIG. 1 a simplified block diagram illustrating an embodiment of a binaural synchronized hearing system according to the invention.

FIG. 1 shows a simplified block diagram illustrating an embodiment of a hearing system according to the invention. This hearing system comprises a first hearing device 10, a second hearing device 20 and a remote control 30.

Each hearing device 10, 20 comprises a microphone 11, 21 as an input transducer, a signal processing unit 12, 22, a loudspeaker 13, 23 as an output transducer. The remote control 30 comprises a hearing program P, a user control unit 31, an information unit 35, a calculation unit 36, a control unit 37, a memory unit 38 and a time measurement unit 39.

In each of the hearing devices 10, 20 the processing unit 12, 22 is operationally connected on its input side to the microphone 11, 21 for receiving an input signal, in particular an audio input signal. On its output side, the signal processing unit 12, 22 is operationally connected to the loudspeaker 13, 23 for forwarding an output signal to the loudspeaker 13, 23 of the respective hearing device 10, 20.

The term "operationally connected" is understood in the meaning that the operation of a second device being connected to a first device is depending on the operation of this first device, even with the presence of one or more interconnecting devices.

Further, the signal processing units 12 and 22 are operationally connected to the remote control 30, in this example via a wireless link as indicated by two arrows, for transmitting information relating to the hearing program P from the remote control 30 to the processing units 12 and 22 respectively. In addition, the memory unit 38, the clock 39 and the user control unit 31 are connected to the information unit 35 for transmitting data to the information unit 35.

In operation of each hearing device 10 and 20, the microphone 11, 21 provides an analog electrical input signal that corresponds to an acoustical input signal. The processing unit 12, 22 receives this input signal and processes it according to hearing program P to provide an analog electrical signal as output signal. The loudspeaker 13, 23 receives the electrical output signal and provides an acoustical output signal, e.g. a sound signal. The acoustical output signal corresponds to the electrical output signal and is emitted from each of the hearing devices 10 and 20 to the respective ear of the user of the hearing system. Thus, the signal processing unit of the first and second hearing device 10 and 20 is controlled by the hearing program P.

The hearing program P is selected from a group of different hearing programs P according to information provided by a software routine that implements a classifier. In this example the classifier automatically determines a momentary acoustic situation by analyzing an acoustic signal captured by one or both microphones 11 and 21 and determines the most appropriate hearing programs P.

In this example, every hour the hearing system performs an adjustment that is based on learnt preference data.

Accordingly, the information unit 35 determines device information by determining a first average control correction $ACCorr(P)_{ipsi}$ of the first hearing device 10. This control correction $ACCorr(P)_{ipsi}$ is an average of data relating to adjustments that have been applied earlier to the hearing program P. This data has been stored earlier in the memory unit 38 as logged data and is read by the information unit 35 for determining the first average control correction $ACCorr(P)_{ipsi}$.

In addition, the information unit 35 determines a first usage time $UT(P)_{ipsi}$ as a time information per hearing program P related to the first hearing device 10. This first usage time $UT(P)_{ipsi}$ is determined based on time data that has been received from the clock 39, e.g. data representing a point in time. This time data, e.g. a starting point and/or a time interval, has also been stored earlier in the memory unit 38 and is transferred to the information unit 35 for determining the first usage time $UT(P)_{ipsi}$.

Similar to the above first hearing device 10, further device information is also determined for the second hearing device 20, in particular by determining a second average control correction $ACCorr(P)_{contra}$ and a second usage time $UT(P)_{contra}$. The complete device information $ACCorr(P)_{ipsi}$, $UT(P))_{ipsi}$, $ACCorr(P)_{contra}$, $UT(P)_{contra}$ is then forwarded from the information unit 35 to the calculation unit 36.

The calculation unit 36 calculates synchronization data by calculating learnt preference data learnt_pref(P) according to the expression:

$$\text{learnt_pref}(P) = \frac{(ACCorr(P)_{ipsi} * UT(P)_{ipsi}) + (ACCorr(P)_{contra} * UT(P)_{contra})}{(UT(P)_{ipsi} + UT(P)_{contra})}$$

with P being the hearing program, $ACCorr(P)_{ipsi}$ being the average control correction per hearing program P of the first or ipsi hearing device, $ACCorr(P)_{contra}$ being the average control correction per hearing program P of the second or contra hearing device, $UT(P)_{ipsi}$ being the usage time per hearing program P of the first hearing device and $UT(P)_{contra}$ being the usage time per hearing program P of the second hearing device. The learnt preference data learnt_pref(P) is then forwarded from the calculation unit 36 to the control unit 37.

The control unit 37 applies the learnt preference data learnt_pref(P) to the hearing program P. Consequently, the two hearing devices 10 and 20 are adjusted resp. synchronized via the above mentioned wireless connection by taking into account the synchronization data learnt_pref(P).

In this embodiment, the control unit 31 comprises two dials L and R according to the left hearing device 10 and right hearing device 20. During the use of the program P, an earlier adjustment may relate to one hearing device 10, 20 only, for example in case the dial L has been activated only. Thus, the first average control correction $ACCorr(P)_{ipsi}$ relates to this activation and the second average control correction $ACCorr(P)_{contra}$ represents the fact that no adjustment has been applied to the second hearing device 20. Thus, also in this situation, the device information is related to both hearing devices 10 and 20.

In a further example, every hour the control unit 31 performs an adjustment that is based on an adjustment prediction. This is accomplished by calculating adjustment prediction data from the average control correction ACCorr $(P)_{contra}$, ACCorr$(P)_{ipsi}$ and/or from the learnt preference data learnt_pref(P) and by applying this adjustment prediction data to the hearing programs P. In this example, the adjustment prediction data is applied at a change from one hearing program P to another hearing program P within the group of different hearing programs P.

Figure 2:
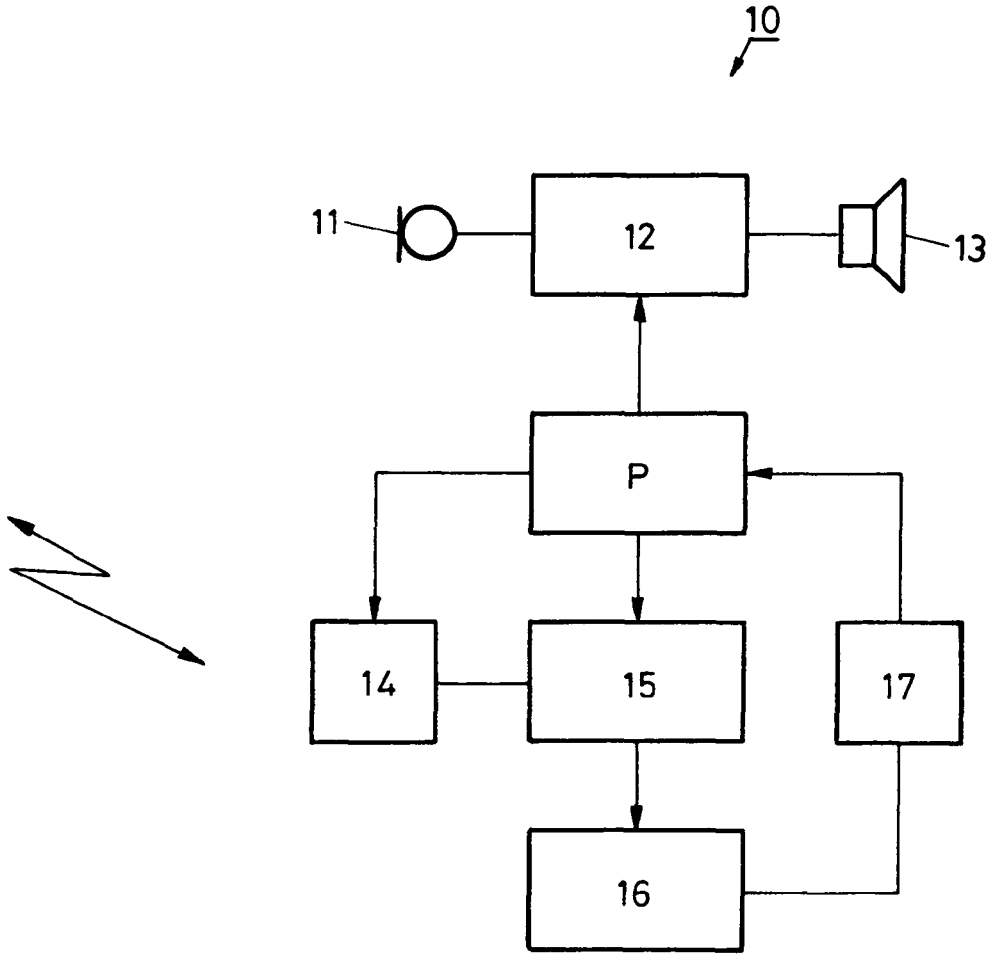
FIG. 2 a simplified block diagram illustrating an embodiment of a hearing device 10 according to the invention.

FIG. 2 shows a simplified block diagram illustrating an embodiment of a hearing device 10 according to the invention. The hearing device 10 comprises the constituents of the above mentioned embodiment according to FIG. 1, in particular the microphone 11, the processing unit 12 and the loudspeaker 13 and their respective connections.

Further the hearing device 10 comprises a hearing program P, an information unit 15, a calculation unit 16 and a control unit 17, each corresponding to the respective constituent of the above mentioned embodiment according to FIG. 1.

The hearing device 10 additionally comprises a receiver 14 for device information from a further hearing device via a wireless connection (indicated by an arrow). In this example the device information comprises an average control correction ACCorr$(P)_{contra}$ and a usage time UT $(P)_{contra}$ per hearing program P of the further device.

Thus, similar to the information unit 35 of the embodiment according to FIG. 1, the information unit 15 determines an average control correction ACCorr$(P)_{ipsi}$ and the usage time UT$(P)_{ipsi}$ of the present hearing device 10. This device information ACCorr$(P)_{ipsi}$, UT$(P)_{ipsi}$ together with the received device information ACCorr$(P)_{contra}$, UT $(P)_{contra}$ is forwarded to the calculation unit 16.

The operation of the calculation unit 16 corresponds to operation of the above mentioned calculation unit 36 (i.e. FIG. 1).

The operation of the control unit 17 basically corresponds to the above mentioned control unit 37 (i.e. FIG. 1), however, the synchronization of the further hearing device is accomplished by applying the learnt preference data learnt_pref(P) via the above mentioned wireless connection to the further hearing device (shown by a double arrow).

Therefore, with the hearing device 10 according to the invention, the present hearing device 10 as well as the further hearing device are adjusted resp. synchronized by taking into account the synchronization data learnt_pref(P).

It is also possible to adjust the present hearing device 10 only. In this case a unidirectional connection is sufficient for receiving the device information from the further hearing device.

It is readily understood that the constituents of the shown embodiments are at least in part merely functional units, which of course can be arranged in various ways, e.g., two or more of them can be united in one physical unit, or one or more of them can be distributed over two or more physical units. Further, many of these functions may be implemented in form of software, e.g. as a program that is executable on a processor such as a signal processor or a microprocessor.

What is claimed is:

1. A method for adjusting a binaural hearing system, the hearing system comprising two hearing devices (10, 20), each comprising a signal processing unit (12, 22) for processing an input signal according to at least one hearing program (P) selected from a group of different hearing programs which control the signal processing of the hearing system to provide an output signal being forwarded to an output transducer (13, 23) of the respective hearing device (10, 20), the method comprising the steps of:

determining device information being related to the hearing devices (10, 20) and to at least one hearing device specific adjustment having been applied to the at least one hearing program (P);

calculating synchronization data according to a function that depends on the device information; and synchronizing the hearing devices (10, 20) by taking into account the synchronization data.

2. The method according to claim 1, wherein the step of determining device information comprises evaluating logged data.

3. The method according to claim 2, wherein the step of determining device information comprises evaluating logged control corrections.

4. The method according to claim 1, wherein the function additionally depends on hearing device specific time information and/or on hearing program specific time information.

5. The method according to claim 4, wherein the function additionally depends on a usage time or an acclimatization time.

6. The method according to claim 1, wherein the function is a weighted average of the device information with weighting factors that correspond to the time information.

7. The method according to claim 1, at least one of the following: the hearing program (P), the device information or the synchronization data, comprising two parts, the first part being related to the first hearing device (10) and the second part being related to the second hearing device (20).

8. The method according to claim 1, the synchronization data comprising learnt preference data, wherein the device information is at least one control correction.

9. The method according to claim 8, the synchronization data comprising learnt preference data, wherein the device information is an average over multiple control corrections, and the time information is a usage time.

10. The method according to claim 1, the synchronization data comprising an acclimatization delta, which is a time-dependent automatic adjustment of the hearing program to bring the hearing program from an initial state towards a target state, wherein the device information is a hearing device specific acclimatization delta and the time information is an acclimatization time.

11. The method according to claim 1, wherein said function additionally depends on side specific user hearing loss information.

12. The method according to claim 1, wherein the hearing system comprises a user control unit (31) for each of the hearing devices (10, 20) and the method further comprises at least one of the following further steps:

deactivating the step of synchronizing if the user control inputs between the hearing devices (10, 20) are repeatedly different;

activating the step of synchronizing if the user control inputs between the hearing devices (10, 20) are substantially identical.

13. The method according to claim 1, wherein each hearing program (P) comprises a set of signal processing parameters for controlling the signal processing of the hearing system depending on a specific acoustic situation for at least one of the two hearing devices (10, 20).

14. The method according to claim 1, wherein the at least one hearing program (P) is selected from the group of different hearing programs according to information provided by a software routine that implements a classifier, which automatically determines a momentary acoustic situation by analyzing an acoustic signal captured by one or both microphones of the two hearing devices (10, 20).

15. The method according to claim 14, wherein the classifier operates independently for each of the two hearing devices (10, 20) or for both hearing devices (10, 20) in common.

16. The method according to claim 14, wherein the classifier comprises two parts, each part being assigned to one of the two hearing devices (10, 20).

17. A binaural hearing system comprising:

two hearing devices (10, 20), each comprising a signal processing unit (12, 22) for processing an input signal according to at least one hearing program (P) to provide an output signal being forwarded to an output transducer (13, 23) of the respective hearing device (10, 20), an information unit (15; 35) for determining device information being related to the hearing devices (10, 20), a calculation unit (16; 36) for calculating synchronization data according to a function that depends on the device information, and a control unit (17; 37) for synchronizing the hearing devices (10, 20) by taking into account the synchronization data, wherein the information unit (15; 35) comprises a means for relating the device information to at least one hearing device specific adjustment having been applied to the at least one hearing program (P), wherein at least one hearing program (P) is selected from a group of different hearing programs which control the signal processing of the hearing system.

18. The hearing system according to claim 17, comprising a memory unit (18; 38) for storing device information or data related to the at least one hearing device specific adjustment.

19. The hearing system according to claim 18, comprising a memory unit (18; 38) for storing logging data.

20. The hearing system according to claim 17, comprising a time measurement unit (19; 39) for determining time information relating to the hearing program (P).

21. The hearing system according to claim 20, wherein the time measurement unit (19; 39) is a counter or a clock and wherein the time information relates to a usage time or to an acclimatization time.

22. The hearing system according to claim 17, the information unit (15; 35) being operationally connected to a receiving unit (14; 34) for receiving at least part of the device information.

23. A hearing device (10) comprising:

a signal processing unit (12) for processing an input signal according to at least one hearing program (P) to provide an output signal being forwarded to an output transducer (13) of the hearing device (10), an information unit (14, 15) for determining device information being related to the hearing device (10) and a further hearing device (20), a calculation unit (16) for calculating synchronization data according to a function that depends on the device information, and a control unit (17) for adjusting the hearing device (10) by taking into account the synchronization data, wherein the information unit (15) comprises a means for relating the device information to at least one hearing device specific adjustment having been applied to the at least one hearing program (P), wherein at least one hearing program (P) is selected from a group of different hearing programs which control the signal processing of the hearing system.

24. A remote control (30) comprising:

an information unit (35) for determining device information being related to two hearing devices (10, 20), a calculation unit (36) for calculating synchronization data according to a function that depends on the device information, and a control unit (37) for synchronizing the hearing devices (10, 20) by taking into account the synchronization data, wherein the information unit (35) comprises a means for relating the device information to at least one hearing device specific adjustment having been applied earlier to the at least one hearing program (P), wherein at least one hearing program (P) is selected from a group of different hearing programs which control the signal processing of the hearing system.

* * * * *

UNITED STATES PATENT AND TRADEMARK OFFICE

CERTIFICATE OF CORRECTION

PATENT NO. : 9,237,403 B2
APPLICATION NO. : 14/356970
DATED : January 12, 2016
INVENTOR(S) : Elmar Fichtl It is certified that error appears in the above-identified patent and that said Letters Patent is hereby corrected as shown below:

In the claims, column 14, line 36, please remove the word - earlier -.

Signed and Sealed this
Nineteenth Day of April, 2016

Michelle K. Lee

Michelle K. Lee
*Director of the United States Patent and Trademark Office*